US005568019A

United States Patent [19]

Mason

[11] Patent Number: 5,568,019

[45] Date of Patent: Oct. 22, 1996

[54] MULTI-GAP HIGH IMPEDANCE PLASMA OPENING SWITCH

[75] Inventor: Rodney J. Mason, Los Alamos, N.M.

[73] Assignee: The Regents of University of California, Oakland, Calif.

[21] Appl. No.: 349,337

[22] Filed: Dec. 5, 1994

[51] Int. Cl.[6] ..... H01J 11/04

[52] U.S. Cl. ..... 315/344; 315/338; 315/340; 315/111.21; 315/111.41; 313/231.31

[58] Field of Search ..... 315/111.21, 111.01, 315/111.41, 338, 340, 344; 313/157, 231.31, 298

[56] References Cited

U.S. PATENT DOCUMENTS

| | | | |
|---|---|---|---|
| 4,194,143 | 3/1990 | Farkas et al. | 315/241 R |
| 4,317,068 | 2/1992 | Ward et al. | 315/209 CD |
| 4,596,945 | 6/1986 | Schumaker et al. | 315/344 |
| 4,721,889 | 1/1988 | Seidel et al. | 315/344 X |
| 4,727,298 | 2/1988 | Mendel | 315/344 X |
| 5,048,068 | 9/1991 | Turchi | 315/344 X |
| 5,132,597 | 7/1992 | Goebel et al. | 315/344 |
| 5,336,975 | 8/1994 | Goebel et al. | 315/344 X |

*Primary Examiner*—Robert Pascal
*Assistant Examiner*—Haissa Philogene
*Attorney, Agent, or Firm*—Milton D. Wyrick; William A. Eklund

[57] ABSTRACT

A high impedance plasma opening switch having an anode and a cathode and at least one additional electrode placed between the anode and cathode. The presence of the additional electrodes leads to the creation of additional plasma gaps which are in series, increasing the net impedance of the switch. An equivalent effect can be obtained by using two or more conventional plasma switches with their plasma gaps wired in series. Higher impedance switches can provide high current and voltage to higher impedance loads such as plasma radiation sources.

10 Claims, 6 Drawing Sheets

G = generator, $R_L$ = Load Resistance

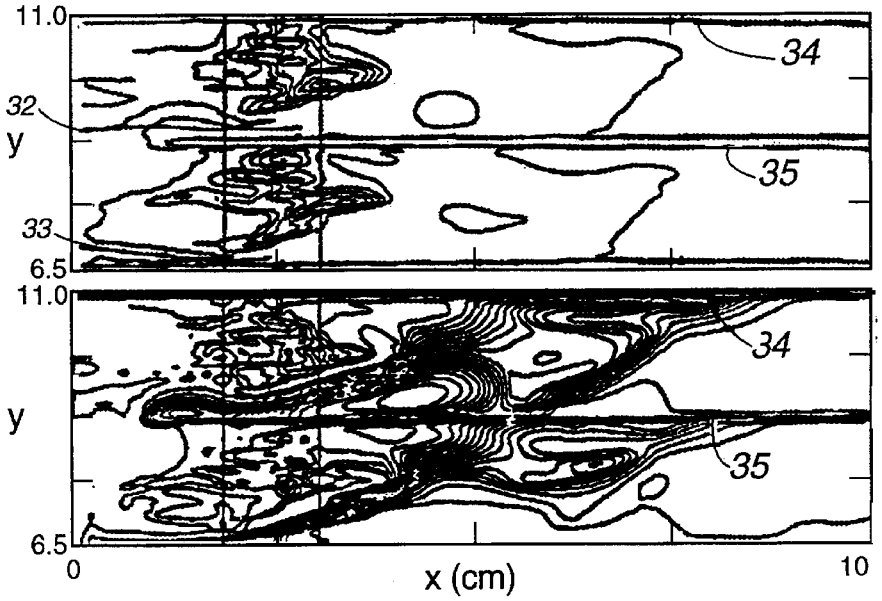
Fig. 3(a)
Fig. 3(b)
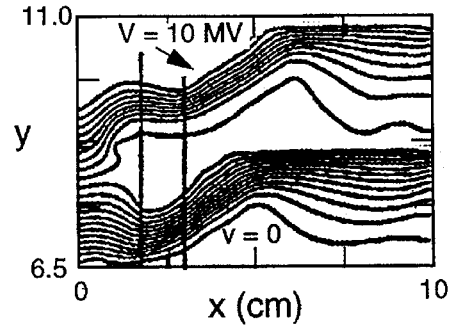
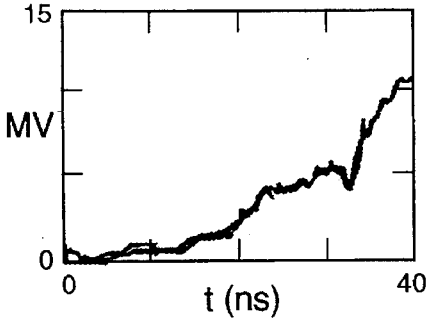
Fig. 3(c)
Fig. 3(d)

MULTI-GAP HIGH IMPEDANCE PLASMA OPENING SWITCH

This invention was made with Government support under Contract No. W-7405-ENG-36 awarded by the U.S. Department of Energy. The Government has certain rights in the invention.

FIELD OF THE INVENTION

The present invention generally relates to high voltage switches, and, more specifically to high impedance plasma opening switches.

In the area of high voltage physics, switches that will withstand very high voltages upon opening while delivering a maximum amount of power to a load, are of great importance. Such switches find application in powering radiation sources, focusing light ion beams for fusion and material processing applications, and generating microwaves having low distortion.

One very important type of such a switch is the plasma opening switch, or "POS." The conventional plasma opening switch consists of a plasma residing between the anode and cathode of a pulse power transmission line, the plasma having been injected through small openings in the anode. The plasma is created through operation of plasma guns or plasma flash boards which produce plasma by the application of a voltage, which causes sparks and emitted plasma at the gun site. The plasma produced by this method is usually comprised primarily of doubly charged carbon atoms ($C^{++}$), and is very tenuous, typically having a density of $10^{14}$ electrons/cm$^3$.

For a very short period of time (on the order of 50 ns to 1 μsec), known as the "conduction time," the plasma in these switches short circuits the current from a generator, typically a Marx bank of capacitors connected between the anode and cathode, allowing for the accumulation and storage of large amounts of magnetic energy. At the end of the "conduction time," the plasma breaks down, and the current flow is disrupted, so that over a shorter period of "opening time," power is delivered to a load connected to the opposite end of the anode and cathode. In some embodiments, the POS is in a cylindrical configuration, with a cylindrical cathode located axially within a larger diameter tubular anode.

As originally used, the POS offered 50 ns "conduction" or storage times during which energy was stored for short circuit loads. Present uses for plasma opening switches, such as for those specified above, call for switches that can conduct for 300 ns and longer, with efficient subsequent opening to load impedances exceeding 7 Ω.

Studies have indicated that POS opening is associated with the formation of a gap in the plasma near the cathode of the switch. At opening, POSs having higher plasma fill densities tend to have smaller plasma gaps, resulting in lower impedance. Therefore, since longer conduction times require higher plasma densities, smaller switch gaps would be developed. However, as stated, smaller gaps imply lower switch impedance, which reduces power transfer to a load. Because of this problem, much recent research has been directed toward enlarging the POS plasma gaps. Suggestions from some of this research have been to use smaller cathode radii for a larger magnetic field to distend the gap, and to use auxiliary axial magnetic fields to push the gaps open. While potentially possible, these methods are not proven, and can significantly complicate the switch.

One other method, as proposed by Dolgachev et al. in Sov. J. of Plasma Phys. Vol. 17, page 679 (1991) involves placing a second, lower density POS in parallel with the first plasma, but further toward the load. Presumably, the second plasma developed its own gap, but the low impedance of the first gap would have controlled the overall impedance. The results indicated that the resultant current pulse rose more steeply at the load, but the overall power transfer efficiency was low.

The present invention provides a more reliable method of effectively enlarging the gap while maintaining excellent power transfer. It accomplishes this by providing multiple plasma gaps in series, producing a higher net switch impedance in parallel with the load, thereby improving power transfer. In this manner, the number of series gaps can be selected which will optimize power transfer to a load.

It is therefore an object of the present invention to provide a plasma opening switch which can provide power conduction times of 300 ns or longer.

It is another object of the present invention to provide a plasma opening switch which can provide high power transfer efficiency into loads of relatively high impedance.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

In accordance with the purposes of the present invention, a high impedance plasma opening switch for connecting an electrical generator to a load comprises an anode connected between the generator and the load, and a cathode spaced apart from the anode and also connected between the generator and the load. At least one electrode, defining a proximal end and a distal end, is disposed between the anode and the cathode, and has its distal end electrically connected to the load. Plasma is injected between the anode and the at least one electrode and between the cathode and the at least one electrode, the plasma forming gaps at the cathode and at the at least one electrode.

In another aspect of the present invention a plasma opening switch providing high voltage, high current and high impedance comprises at least two plasma opening switches each having an anode and a cathode with plasma between the anode and the cathode in a plasma area, the anode and the cathode having proximal and distal ends, and having the proximal end of the anode of a first plasma opening switch connected to a generator and the proximal end of the cathode of the first plasma opening switch connected to the plasma area of a next plasma opening switch, the connections between succeeding proximal ends of the cathodes and the plasma areas of the anodes continuing until a last plasma opening switch has the proximal end of its cathode connected to the generator. In this manner a series connection is established through all of the plasma areas of the at least two plasma opening switches providing the desired high impedance.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings:

FIG. 3 is a graphical representation of the simulations run for a POS according to the present invention also with electron density, $n_e$, at t=18 ns being shown at (a); corresponding B-field contours at (b); voltage contours at 40 ns at (c); and a plot of load versus time at (d).

DETAILED DESCRIPTION

The present invention provides a plasma opening switch (POS) which is capable of both long conduction times and high efficiency power transfer to a load. This is accomplished by the introduction of a one or more additional electrodes inside the POS, or wiring individual POSs together. Either configuration effectively adds plasma gaps in series, raising the total gap impedance.

Figure 1:
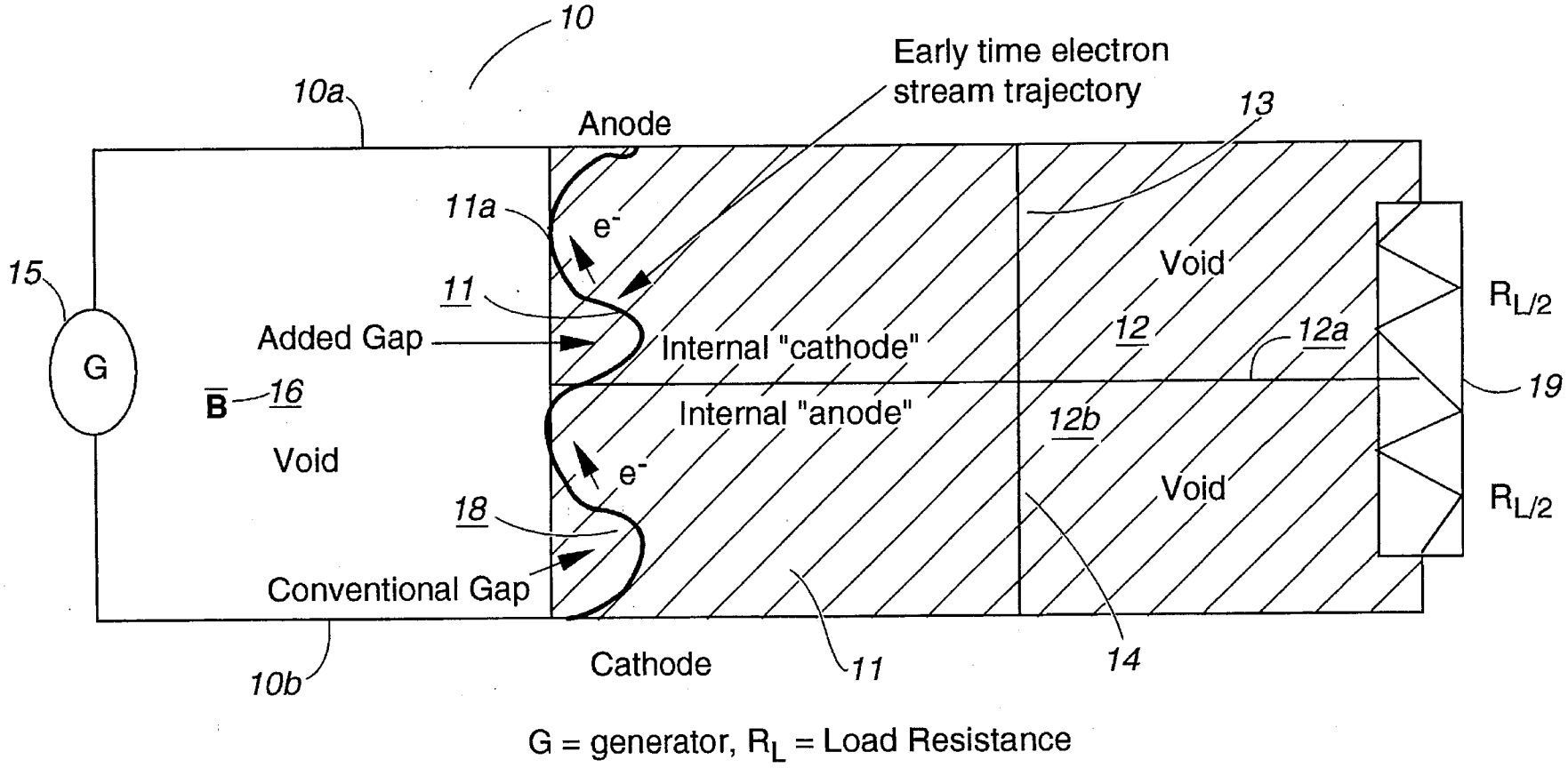
FIG. 1 is a schematic cross-sectional view of a plasma opening switch (POS) according to the present invention.

The present invention may be more clearly understood through reference to the drawings. FIG. 1 shows a schematic of a typical POS 10, but with the addition of an extra electrode, electrode 12. As illustrated, electrode 12 effectively adds internal cathode 12*a* and internal anode 12*b* with reference to anode 10*a* and cathode 10*b* of POS 10.

Electrode 12 is located equidistant from anode 10*a* and cathode 10*b* of POS 10. A plasma 11 is injected into POS 10 through ports in anode 10*a* and cathode 10*b*, by the operation of a plasma gun, flash board or laser ionized gas jets, or other plasma generator (not shown). An applied magnetic B-field 16 due to the action of generator 15, which may be a Marx bank of capacitors, arises in the void region adjacent to plasma 11, and is temporarily restrained by plasma 11.

The B-field 16 penetration behavior in upper area 13, and in lower area 14 of POS 10 is nearly identical, that is, at any given time, nearly equal values of B-field 16 are found in corresponding points in plasma 11 in upper area 13 and lower area 14. In other embodiments of the present invention, electrode 12might not be equidistant from anode 10*a* and cathode 10*b*, but could have its position with respect to anode 10*a* and cathode 10*b* adjusted, along with the plasma densities in areas 11*a*, 11*b*, to ensure that the B-field 16 penetration in area 13 and area 14 is nearly identical.

As current is supplied to POS 10 by generator 15, B-field 16 is impressed onto plasma 11, and current begins to flow along its surface 11*a* which faces generator 15. As time progresses, upper gap 17 forms adjacent to internal cathode 12*a*, and lower gap 18 forms adjacent to cathode 10*b*, as electrons are accelerated out of electrode 12 and out of cathode 10*b*, and ions are accelerated into electrode 12 and into cathode 10*b*. Above internal cathode 12*a* and conventional cathode 10*b*, as gaps 17 and 18 form, potential hills are formed. Below anode 10*a* and internal anode 12*b*, B-field 16 penetrates axially by way of an electromagnetohydrodynamic (EMHD) magnetic wave.

Plasma 11 which is above internal cathode 12*a*, and plasma 11 which is between electrode 12 and cathode 10*b*, each sense the same driving B-field 16, and each develops a similar cathode gap 17, 18. It is important in the design of the present invention that sufficient space be allowed between internal electrodes 12, and anode 10*a* and cathode 10*b* so that each layer of plasma 11 can develop the resistance characteristics of a single conventional POS, as following from the full opening of a single plasma gap, while the effective load driven by each layer is reduced by an amount related to the total load resistance divided by the number of layers.

Since additional layers allow the ratio of the switch impedance to the effective load impedance to be multiplied, energy transfer to the load is improved. However, it should be realized that, at some point, the number of additional electrodes 12 will cause the available space for plasma 11 to be too small to contain all the gaps 17, 18. In the single electrode 12 case, illustrated in FIG. 1, plasma 11 can be injected from above and below POS 10. With more than one electrode 12, plasma injection is more difficult.

Figures 2A, 2B, 2C, 2D:
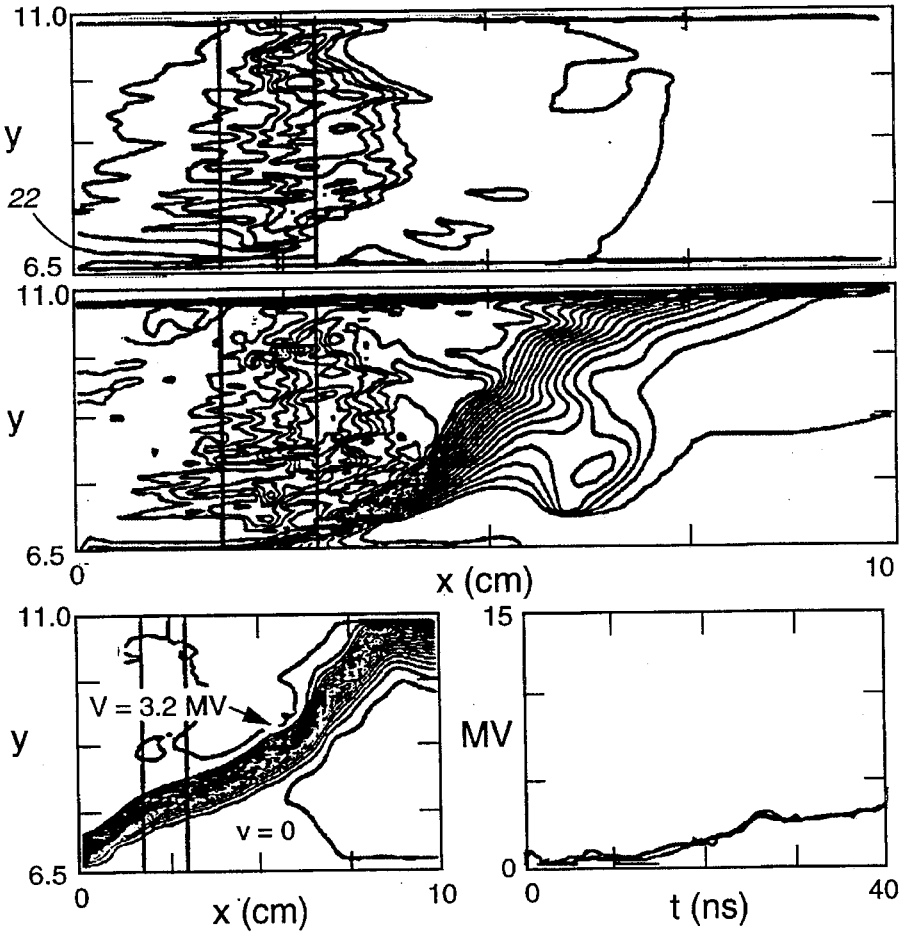
Fig. 2d Prior Art
FIG. 2 contains graphical representation of simulations run for a conventional POS with electron density, $n_e$, at t=18 ns being shown at (a); corresponding B-field contours at (b); voltage contours at 40 ns at (c); and a plot of load versus time at (d).

Because of the nature of this invention it is both practical and helpful to run computer simulations to check performance. In one case, illustrated in FIG. 2, a prior art, conventional POS having an anode-cathode gap of 4.5 cm was studied using the ANTHEM software (fully described in R. J. Mason, *J. Comput. Phys.*, 71, p. 429 (1987) and in R. J. Mason, "ANTHEM USER'S MANUAL-Edition 1.1," Los Alamos Report, LA-UR-93-888, Mar. 5, 1993). In accordance with the requirements of this software, a computational mesh of 50×100 (x,y) cells was selected. High resolution (100 cells), in the y-direction of the mesh, was needed to resolve early time density gap formation. FIG. 2, frame (a), illustrates the electron density at t=18 ns, and frame (b), shows corresponding B-field 16 (FIG. 1) contours in the POS. Frame (c) shows voltage contours computed from the integral:

$$V(x,y) = -\int_0^y E_y(x,y)dy$$

at t=40 ns, when the POS is "open," and frame (d) illustrates a plot of load voltage versus time. Single cathode gap 22 is clearly shown in frame (a).

At FIG. 2(*c*), the time dependent load voltage is shown, where V(x=10, y=11, t) is plotted. The $C^{++}$ plasma density is uniformly $5\times10^{14}$ electrons/cm$^3$, so conditions are comparable to those for a 300 ns POS, with the exceptions that the POS switch plasma is narrower in the axial direction, and the field rises significantly faster to encourage rapid opening for computational economy. The electron density contours show a 3 mm gap 22 at t=18 ns. By the time 40 ns has elapsed, it is found that the plasma has been pushed back to 1.7 cm as evidenced by the voltage contours which pass just under the fill plasma (FIG. 2(*c*)). By t=38 ns, the voltage at the load has risen to 3.2 MV.

In FIG. 3, also containing frame (a), (b), (c) and (d) illustrations, a simulation as above was run, but with an extra electrode 12 (FIG. 1) according to the present invention inserted at the middle point between anode 10*a* and cathode 10*b* (FIG. 1). For the purposes of the simulation, Electrode 12 has a width of 0.09 cm, and can absorb ions and emit electrons. The total load remained at 80 Ω. As shown in FIG. 3, at frame (a), opening proceeds with the formation of two cathode gaps 32, 33, and two magnetic anode layers 34, 35. As shown, cathode gaps 32, 33 are opening by t=9 ns. By t=18 ns, there is considerable vacuum power flow in both layers. The V(x,y) contours show voltage drop across two separate vacuum power flow streams, one associated with each cathode gap 32, 33. At t=18 ns, the load voltage is 1.8 MV, as compared with 1.2 MV in the single module case, shown in FIG. 2. By t=38 ns, the load voltage has climbed to 10 MV, a significant improvement over the 3.2 MV registered with the conventional POS.

In another simulation with a conventional POS, with only a 2.25 cm anode to cathode gap, the voltage rose linearly over a period of 12 ns, to a peak of 4.3 MV at t=39 ns. This result indicates that while some impedance improvement with the double modules of the present invention stems from the smaller size per module, most results from the plural gaps 32, 33. Actually, with two equally spaced internal electrodes 12 (FIG. 1) introduced into a POS with a 4.5 cm anode to cathode gap, a load voltage of 15 MV was achieved at t=35 ns. This indicates that each additional gap provides a significant increase in switch impedance.

In other simulations, electrode 12 (FIG. 1) was terminated at a point 1 cm before the load, but yielded the same 10 MV load voltage. The vacuum power flow in the lower module simply continued beyond electrode 12 to an intersection point in load resistor 19 that essentially sustained the "connected" net load voltage. Alternatively, with the middle electrode 12 reduced to only 2 cm in total length, the vacuum power flow reversed, and joined with the upper module 13 power flow, reducing the voltage drop to single module values. This indicates that electrode 12 must be carefully designed in order to achieve optimal load coupling.

In actual applications, it will be probable that switch plasmas 11 (FIG. 1) will be likely to manifest significant density non-uniformities, such as mid-electrode density minima. Still, the electrical current can be engineered to pass serially through multiple modules of this type of plasma 11 for a net increase in switch impedance. In analyses of the sensitivity of the POS according to the present invention to plasma 11 density variations between the various plasma layers, studies of 50% density variations in the plasmas between plasma in the upper and lower modules 13, 14 were conducted. In one case, the density of plasma 11 in one module was set at $8\times10^{14}$ electrons/cm$^3$, while the other module was held at $5\times10^{14}$ electrons/cm$^3$. In another case, the first module was reduced to $2\times10^{14}$ electrons/cm$^3$, while the second remained at $5\times10^{14}$ electrons/cm$^3$. In both cases, only a 5% decrease in peak load voltage was experienced.

Figure 4:
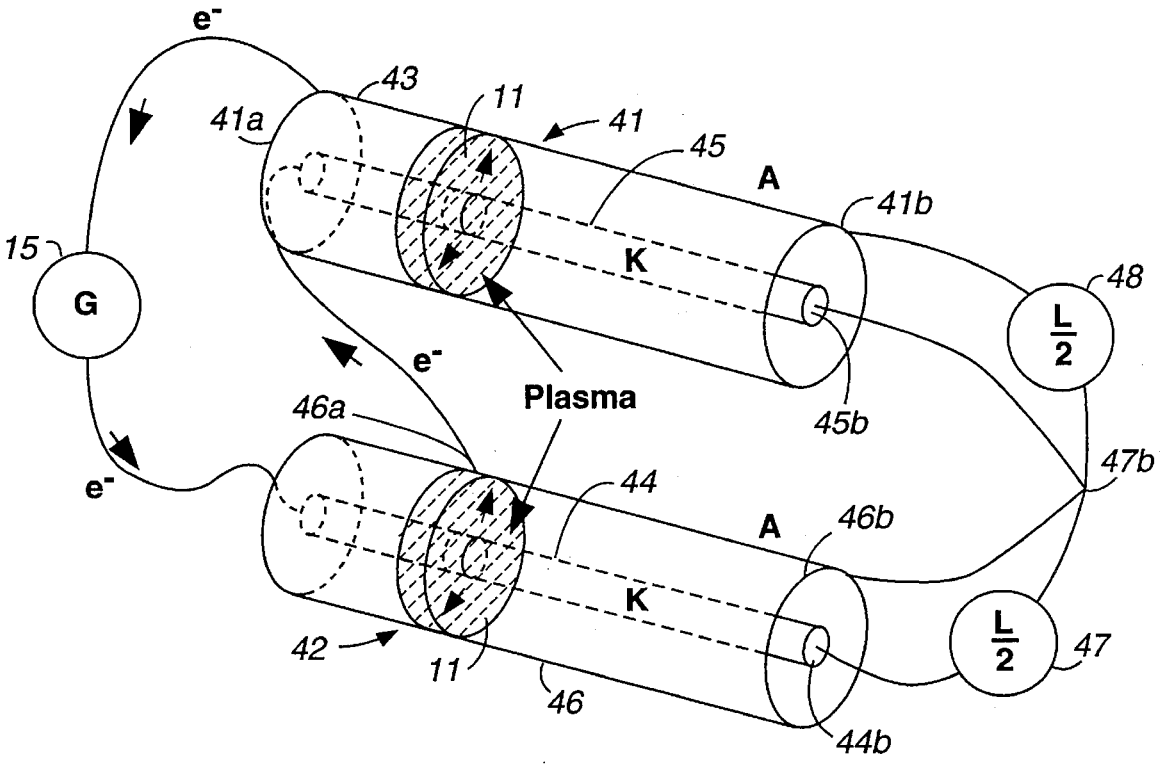
FIG. 4 is a schematic representation of an embodiment of the present invention in which two conventional cylindrical POSs are interconnected so as to provide the multiple plasma gaps according to the present invention.
Figure 5:
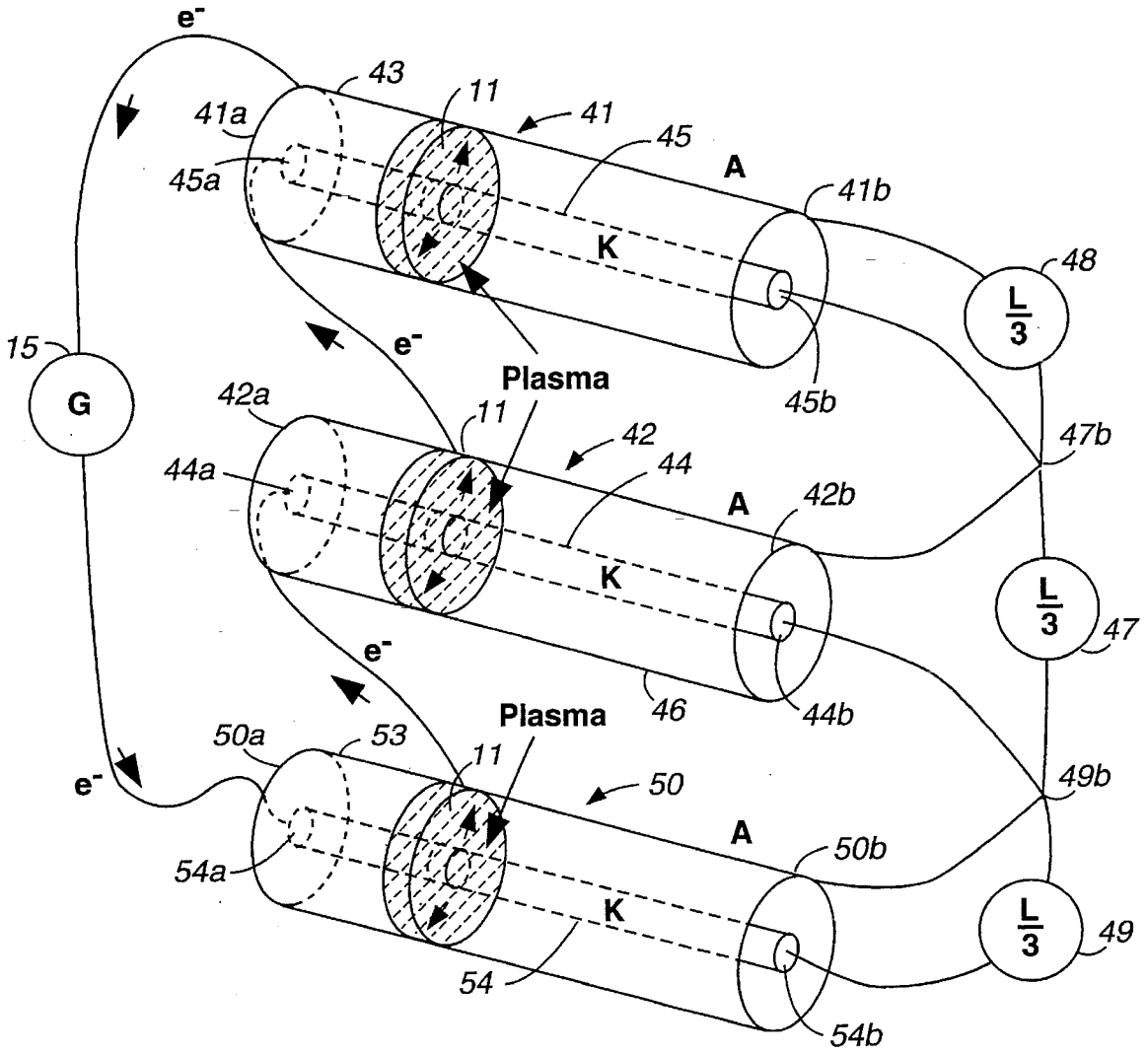
FIG. 5 is a schematic representation of the embodiment of FIG. 4 in which a third conventional POS is employed, and which indicates the interconnections necessary for three or more POSs to have their impedances add according to the present invention.

The improvement in POS operation afforded by the present invention is presented in other important embodiments of the invention: the coupling of individual, more conventional POSs. These embodiments are illustrated in FIGS. 4 and 5, and provide for the application of the additional plasma gaps of the invention without introducing additional internal electrodes 12. To accomplish this, two or more conventional POS coaxial switches could be coupled together, as shown for two POSs 41, 42 in FIG. 4. In this situation the anode point 46*a* at the area of plasma 11 of lower POS 42, is connected to cathode 45 of upper POS 41. These connections would be repeated for each additional POS, with generator 15 directly connected only to cathode 44 of POS 42 and the anode of the last POS. This provides for a net serial current path through all the switch plasmas, and through all the switch gaps, as discussed below, providing the additional gaps needed to accomplish the high impedance POS according to the present invention.

Output power is drawn from anode 43 of upper POS 41 at load end 41*b* through ½ load 48 and then through ½ load 47 to lower cathode 44*b*. Load end 46*b* of anode 46 is also connected at connection point 47*b* to the load end of upper cathode 45 and to mid connection point 47*b*. Upon "opening," mid-connection point 47*b*, upper cathode 45, and lower anode 46 are all at the same voltage.

It should be understood that if a third POS is employed, as is illustrated in FIG. 5, anode 46 remains connected to cathode 45 at generator end 41*a*, and cathode 45 at load end 45*b* remains connected to connection point 47*b* between what is L/3 load 48. As shown, generator 15 is now connected from anode 43 at end 41*a* to end 54*a* of cathode 54 of POS 50. As with POSs 41, 42, anode 53 is connected to end 44*a* of cathode 44. Cathode 44 at end 44*b* is connected to connection point 49*b* between L/3 loads 47, 49. Cathode 54 at end 54*b* is connected to L/3 load 49. Any additional POSs would be connected in the same manner.

The modularity afforded by this embodiment of the invention can achieve significantly high current delivery at high voltages. These are the requirements for hot spectrum radiation effect studies, and light ion fusion.

Figure 6:
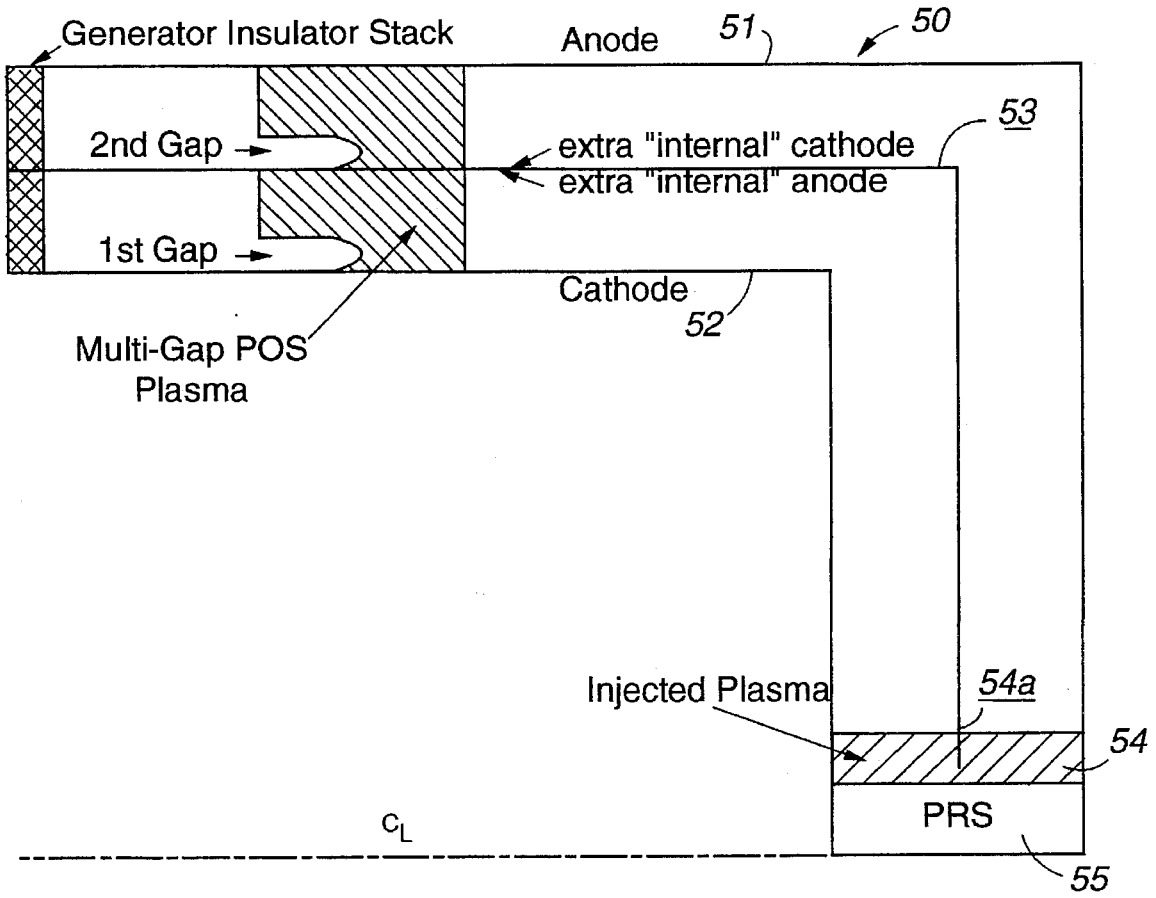
FIG. 6 is a schematic cross-sectional view of a cylindrical POS according to the present invention which is in an L-shape and has its internal cathode connected through injected plasma to the mid-point of a plasma radiation source serving as the load.

Yet another embodiment is illustrated in FIG. 6 which will find utility with inductive loads such as plasma radiation sources (PRS). Such plasma radiation sources include, but are not limited to imploded foils, Z-pinches, and plasma filled diodes. Plasma radiation sources have many uses in the high power community for such uses as radiation hardening of equipment and devices, and in material processing of semiconductors.

Here, POS 50 power feed is L-shaped, with internal electrode 53 also configured in an L-shape at the mid-point between anode 51 and cathode 52. This embodiment can be used, for example, to efficiently drive a plasma filled diode. As seen, internal cathode 53 terminates inside injected plasma 54, at its mid-point 54*a*, injected plasma being employed for connection with the desired plasma radiation source 55. By terminating internal cathode 53 at mid-point 54*a* of injected plasma 54, the load has been effectively staged so that the voltage drop across each stage of plasma radiation source 55 is equal.

With the present invention, substantially increased voltages across plasma radiation sources can be achieved in proportion to the number of plasma layers and gaps employed through the use of multiple POS modules as described above. Thus, the present invention provides the means for increasing both the inductance, L, and the quantity dL/dt, for faster plasma radiation source implosions, and higher source temperatures.

In the best cases, the inductance can vary as $L\sim V\sim 1/r^2$. This means that, for a plasma specific heat of $\gamma=2$, it is expected that $T\sim 1/r^2\sim V$. Where the prior art has previously achieved 90 eV radiation temperature upon implosion of the PRS, the present invention would make the attainment of 180 eV, or 360 eV possible.

Returning to FIG. 1, it can be seen that internal electrode 12 can be mechanically fixed in position in any convenient manner which is made possible by the specific POS 10 geometry. One practical method is to secure electrode 12 with the dielectric material (not shown) which is conventionally at the end of POS 10 at which generator 15 is connected. The opposite end of electrode 12 can be secured into the load 19. The same technique would apply when more than one electrode 12 is employed.

Of course, as described above, electrode 12 can be terminated short of load 19. Because of this possibility, the term "electrically connected" is used herein to refer to the case where electrode 12 is terminated within load 19, in which case a mechanical connection is made, and to the case where electrode 12 is terminated short of load 19, and the connection is made through vacuum power electron flow.

Insertion of plasma 11 can be accomplished in any of several ways. A plasma source can be placed below cathode 10*b* of POS 10, or inside cathode 10*b* if it is annular in shape, and/or above anode 10*a* of POS 10. Internal electrodes 12 can be porous to allow plasma to pass through them. Plasma also can be inserted axially from the region of load 19. When multiple electrodes 12 are used, care will need to be exercised in order to obtain optimal density for plasma 11 between all electrodes 12.

In the case of coaxial electrodes, the magnetic field is weak at larger radii, so the density in the outer modules will need to be lower in order to tune the opening times to match in all modules. An experimental (or simulated) trial and error period is recommended prior to the applied use to establish optimal tuning.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A high impedance plasma opening switch for connecting an electrical generator to a load comprising:

an anode connected between said generator and said load;

a cathode spaced apart from said anode and connected between said generator and said load;

at least one electrode, defining a proximal end and a distal end, disposed between said anode and said cathode, and having said distal end electrically connected to said load and no external connection to said proximal end;

plasma injected through ports in said anode and cathode between said anode and said at least one electrode and between said cathode and said at least one electrode, said plasma forming—density—gaps at said cathode and at said at least one electrode upon the establishment of a magnetic B-field between said anode and said cathode.

2. The plasma opening switch as described in claim 1 wherein said anode, said cathode and said at least one electrode terminate in said load.

3. The plasma opening switch as described in claim 1 wherein said anode and said cathode terminate in said load, and said at least one electrode terminates at a position spaced apart from said load.

4. The plasma opening switch as described in claim 1 wherein said anode is cylindrically shaped; said cathode is cylindrically shaped and coaxially located within said anode, and said at least one electrode is cylindrically shaped and located coaxially with and between said anode and said cathode.

5. The plasma opening switch as described in claim 1 wherein said anode, said cathode and said at least one electrode are cylindrically shaped, define an "L" shape and terminate at said load.

6. The plasma opening switch as described in claim 5, wherein said at least one electrode is connected to said load through a plasma in contact with said at least one electrode and said load.

7. The plasma opening switch as described in claim 5, wherein said load comprises a plasma radiation source.

8. A plasma opening switch providing high voltage, high current and high impedance comprising:

at least two plasma opening switches each having an anode and a cathode with plasma between said anode and said cathode in a plasma area, said anode and said cathode having proximal and distal ends, and having said proximal end of said anode of a first plasma opening switch connected to a generator and said proximal end of said cathode of said first plasma opening switch connected to said plasma area of a next plasma opening switch, said connections between succeeding said proximal ends of said cathodes and said plasma areas of said anodes continuing until a last plasma opening switch has said proximal end of its cathode connected to said generator;

whereby a series connection is established through all of said plasma areas of said at least two plasma opening switches providing said high impedance.

9. The plasma opening switch as described in claim 8 wherein a divided load is connected to said distal ends of said at least two plasma opening switches each division of said divided load being connected between the anode and cathode of each of said at least two plasma opening switches.

10. The plasma opening switch as described in claim 8 wherein said at least two plasma opening switches comprise two plasma opening switches.

* * * * *